United States Patent [19]

Godlewski

[11] 4,371,144

[45] Feb. 1, 1983

[54] MOTOR SECURING DEVICE FOR WATERCRAFT

[76] Inventor: Harry H. Godlewski, 5454 California Ave., Bethel Park, Pa. 15102

[21] Appl. No.: 252,956

[22] Filed: Apr. 10, 1981

[51] Int. Cl.[3] ..... B63B 7/08

[52] U.S. Cl. ..... 248/641; 114/345; 114/364; 114/270; 114/343; 440/6; 440/113

[58] Field of Search ..... 248/640-643; 429/163, 176, 96-100; 9/2 R, 2 A, 11 A, 1.7; 440/6, 7, 900; 441/345, 347, 364; 180/68.5

[56] References Cited

U.S. PATENT DOCUMENTS

| | | | |
|---|---|---|---|
| 2,150,420 | 3/1939 | Cooper | 115/17 |
| 2,334,072 | 11/1943 | Cooper | 9/2 |
| 2,456,086 | 12/1948 | Schwall | 9/2 |
| 2,468,287 | 4/1949 | Buhler | 248/4 |
| 2,497,490 | 2/1950 | Daniels | 115/17 |
| 2,930,345 | 3/1960 | Gaston | 248/641 |
| 3,119,365 | 1/1964 | Evans | 248/642 |
| 3,665,534 | 5/1972 | McIntyre | 9/2 A |
| 3,881,442 | 5/1975 | Seiple | 115/0.5 A |
| 3,965,844 | 6/1976 | Brock | 440/6 |
| 4,021,873 | 5/1977 | Francois | 9/2 A |
| 4,303,333 | 12/1981 | King | 440/6 |

*Primary Examiner*—Trygve M. Blix
*Assistant Examiner*—D. W. Keen
*Attorney, Agent, or Firm*—Buell, Blenko, Ziesenheim & Beck

[57] ABSTRACT

A motor securing device for watercraft such as inflatable boats and rafts and the like including generally downwardly open securing portion which may be defined by a pair of parallel walls and a connecting wall. A motor attachment portion projects generally upwardly from a rear portion of the securing section. A battery-securing shelf extends forwardly from the securing portion. Securing a motor to the upwardly projecting wall and a battery positioned on the supporting shelf provide a counterbalancing action. Retaining structures may be provided to resist undesired displacement of the battery or motor securing clamp.

15 Claims, 7 Drawing Figures

MOTOR SECURING DEVICE FOR WATERCRAFT

BACKGROUND OF THE INVENTION

1. Field of the Invention

This invention relates to a device for securing a motor to watercraft and, more specifically, relates to such a device adapted to secure both an electric motor and a battery to watercraft including inflatable boats, rafts, pantoon-type vessels and the like.

2. Description of the Prior Art

Various means of securing both gasoline and electric motors to watercraft have been known.

With respect to inflatable boats, rafts and the like, difficulty in securing motors to such craft has frequently resulted in the need to use manual oars as the prime means of moving the craft across a body of water.

Various means have been suggested for securing a motor to an inflatable boat.

U.S. Pat. No. 3,881,442 discloses the use of a coiled metal structure which is adapted to receive the uninflated boat. Inflation of the boat is said to cause uncoiling of the structure.

U.S. Pat. No. 2,456,086 discloses a collapsible boat wherein an attaching plate is said to cooperate with a body and connecting straps.

U.S. Pat. Nos. 2,150,420 and 2,334,072 disclose a curved base plate which is said to fit around the stern portion of the inflatable boat and cooperate with an upward extension member on which a motor is adapted to be clamped. The anchor structures are secured to the boat by means of straps.

U.S. Pat. No. 2,468,287 discloses a motor mount for an inflatable vessel which consists of a pair of jaws which are lever operated employed as a means of establishing desired camming and clamping action to position a mounting plate in the desired location.

U.S. Pat. No. 3,665,534 discloses a fishing float in the nature of an innertube which has secured exteriorly thereto an enlarged housing which is adapted to receive a pair of batteries and have secured to the rearmost portion an electric motor.

U.S. Pat. No. 2,497,490 discloses an outboard motor mount for an inflatable boat which provides a rear mounting bracket and a stabilizer element which is adapted to be secured in underlying position with respect to side portions of the boat.

There remains, therefore, a substantial need for a device which will effectively and economically secure an electrical motor to watercraft such as an inflatable boat, raft or the like while providing support means for a battery and providing such design in a fashion which effects mechanically efficient interrelationship therebetween.

SUMMARY OF THE INVENTION

The present invention has solved the above-described problems by providing a lightweight, economical motor securing device which includes securing means which are generally downwardly open and adapted to secure the device to the watercraft, motor attachment means projecting generally upwardly from a rear portion of the securing means and a battery securing shelf extending forwardly from the securing means to provide a counterbalancing effect between the motor and battery. The securing means preferably are defined by a pair of generally parallel walls and a connecting wall. Restraining means are provided to resist undesired displacement of the battery. Wall means serve to resist undesired displacement of a motor clamp which secures the motor to the device.

It is an object of the present invention to provide an efficient and economical means for securing an electric motor and battery to watercraft, with particular emphasis on inflatable watercraft.

It is another object of this invention to provide such a device which is lightweight and simple to install.

It is yet another object of the present invention to provide such a device which has effective mechanical counterbalancing action.

It is another object of the present invention to provide such a device which can be made as a unitary structure and can be employed while avoiding potentially hazardous damage to the watercraft.

These and other objects of the invention will be more fully understood from the following description of the invention on reference to the illustrations appended hereto.

DESCRIPTION OF THE PREFERRED EMBODIMENTS

Figure 1:
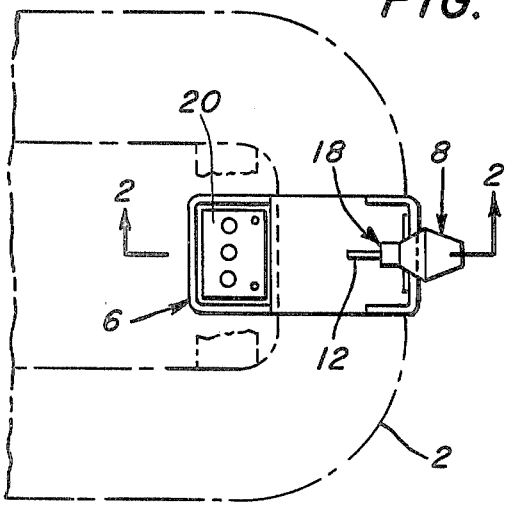
FIG. 1 is a fragmentary top-plan view of a portion of a watercraft having a motor securing device of the present invention secured thereto.
Figure 2:
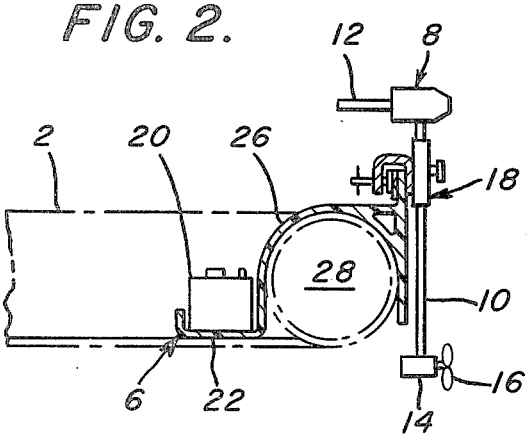
FIG. 2 is a cross sectional illustration taken through 2—2 of FIG. 1.

Referring now to FIGS. 1 and 2 in greater detail, the motor securing device of the present invention is secured to a stern portion of an inflatable raft 2. The motor securing device 6 has means for receiving electric motor 8 which has drive shaft 10 cooperating with gear box 14 to deliver power to propeller 16. An operating handle 12 permits orientation of the propeller so as to provide thrust in the desired direction. A clamp member 18 secures the motor assembly to a portion of the motor securing device. A battery 20 is supported on a shelf 22 which is also a portion of the motor securing device 6. As is shown in FIG. 2, an inflated portion 28 of raft 2 is received within securing means 26 of motor securing device 6.

Figure 4:
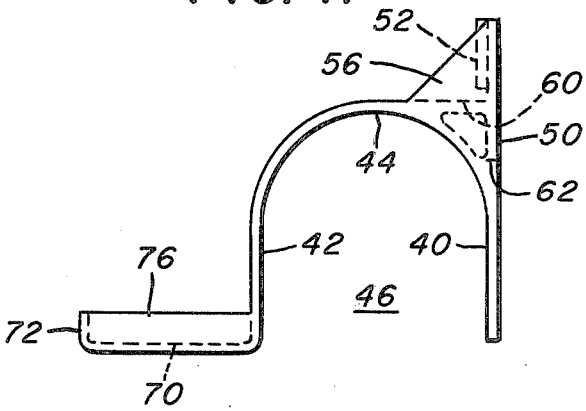
FIG. 4 is a front-elevational view of the motor securing device shown in FIG. 3.
Figure 5:
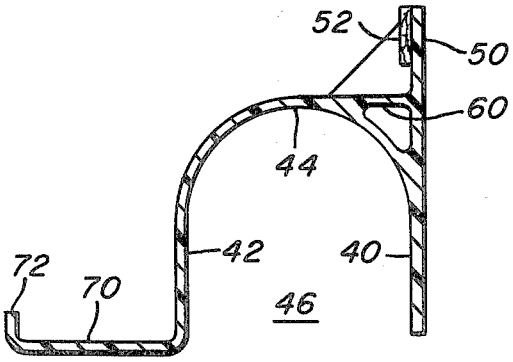
FIG. 5 is a cross-sectional illustration of the motor securing device of FIG. 3 taken through 5—5 of FIG. 3.

Referring now in greater detail to FIGS. 4 and 5, it is seen that the securing means for engaging the watercraft includes, in the form shown, a pair of generally parallel sidewalls 40, 42 and a generally circular connecting wall 44. For convenience of reference, the wall 40 will be deemed the rear wall and the wall 42 will be deemed the forward wall. It will be appreciated, however, that as used herein, references to relative direction such as "upwardly", "downwardly", "rearwardly", "forwardly" and related terms shall be used only for clarity of description in a relative sense and shall not be deemed to be limitations on the invention. In attaching the motor securing device to the watercraft, the downwardly open channel 46 defined by walls 40, 42, 44 will receive the portion 28 of the inflatable raft, for example, in intimate mechanical engagement. It is noted that the surfaces of walls 40, 42, 44 are preferably smooth so as to resist potentially damaging puncturing of the inflatable craft. In the preferred form, the width of the channel 46 (defined between walls 40, 42) will be such as to provide for a tight resiliently maintained interfit between section 28 and channel 46. If desired, the device may be made so as to have adjustable channel widths to fit different size vessels. This might readily be accomplished, for example, by providing a split in connecting wall 44 with elongated slots having bolts passing therethrough and fasteners such as wing nuts employed to secure the walls 40, 42 in different relative positions. Alternatively, a series of openings in one portion of a split connecting wall 44 may be aligned with an opening in the other section with the fasteners securing the two sections in the desired relative position.

Figure 3:
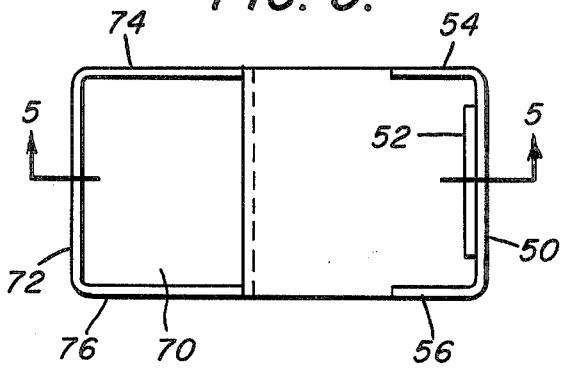
FIG. 3 is a top-plan view of a motor securing device of the present invention.

Referring to FIGS. 3 through 5, the motor transom or wall 50 to which the clamp 18 is secured will now be considered in greater detail. The motor transom or motor attachment wall 50, in the form shown, is generally coplaner with rear wall 40 and may be considered an upward extension thereof. In a preferred form, a block of compressible material such as wood or plastic 52 is secured to the forward surface of wall 50 in order to facilitate intimate engagment by the clamp 18. A pair of lateral walls 54, 56, which in the form shown are generally triangular in shape, are connected to the ends of wall 50 and serve to resist undesired lateral movement of the portion of the clamp 18 disposed forwardly of wall 50. Floor 60 connects wall 50 with connecting wall 44.

For convenience of reference herein, the wall 40 will be deemed to terminate at the junction with wall 44 and, similarly, wall 50 will be deemed to begin at such point. For general reference, in FIG. 4, a line 62 has been positioned so as to provide a general indication as to where this transition occurs. This line is merely for reference purposes in the drawings and need not be a structural element.

Referring still to FIGS. 3 through 5, there is shown the battery supporting shelf 70 which has an area sufficient to support battery 20. As it is, of course, important to restrain the battery against undesired movement which might cause it to fall off of the shelf, the present invention, in the form shown, provides means for resisting undesired movement of this type. Lateral wall sections 72, 74, 76 which preferably provide a generally continuous U-shaped restraint are disposed at or adjacent the periphery of shelf 70. If desired, additional battery securing means, such as straps, for example, may be provided.

Figure 6:
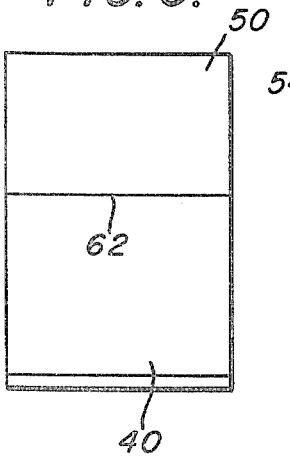
FIG. 6 is a right-side elevational view of the motor securing device shown in FIG. 3.
Figure 7:
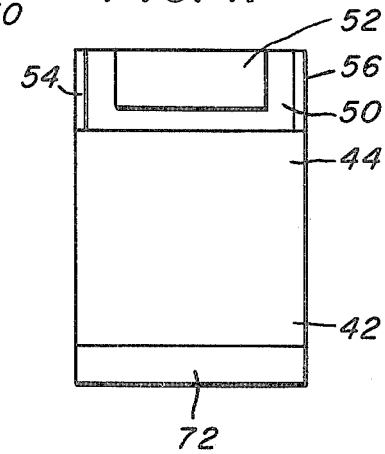
FIG. 7 is a left-side elevational view of the motor securing device shown in FIG. 3.

FIGS. 6 and 7 illustrate, respectively, the right and left side elevational views of the motor-securing device.

With the exception of block 52 which may be eliminated, if desired, the entire device may advantageously be made as a unitary article. This provides for convenience of handling, integrity of the device and may improve economies. Among the preferred materials are plastic, aluminum and steel. A particularly suitable material is that sold under the trade designation Fiberglas.

The shelf 70 preferably has an average width measured along the direction of peripheral wall 72 of about one-half to one-and-one-half times the width of the securing means measured in the same general direction. In the form shown, the device has a generally uniform width throughout its longitudinal extent which is equal to the width of the securing device.

It will be appreciated that when both the motor and battery are in position as shown in FIGS. 1 and 2, the motor applies a moment in a clockwise direction to the wall 50 and the battery 20 applies a moment in a counterclockwise direction to the shelf 22. As a result of at least partial cancellation of these moments, this provides a stable mechanical system which resists undesired separation of the motor-supporting device from the watercraft.

While for simplicity of disclosure herein, prime reference has been directed toward the use of the invention in connection with inflatable watercraft composed of various materials, it will be appreciated that the device may be employed advantageously in connection with other forms of watercraft whether or not inflatable and whether or not the transom has the dimension or shape of the section 28 shown in FIG. 2. For application to somewhat rigid transom portions, a resilient inner liner may be provided within channel 46 so as to facilitate effective interengagement.

It will be appreciated, therefore, that the present invention provides effective means for economically and securely attaching a motor and battery to watercraft.

Whereas particular embodiments of the invention have been described above for purposes of illustration, it will be appreciated by those skilled in the art that numerous variations of the details may be made without departing from the invention as described in the appended claims.

I claim:

1. A motor securing device for watercraft comprising generally downwardly open securing means for securing said device to said watercraft, motor attachment means projecting generally upwardly from a rear portion of said securing means, said securing means having a channel for receipt of a portion of said watercraft, a battery securing shelf connected to and extending forwardly from said securing means, whereby a motor secured to said motor attachment means and a battery disposed on said shelf will provide a counterbalancing action and, retainer means for resisting undesired displacement of a battery disposed on said shelf.

2. The motor securing device of claim 1 including said watercraft being inflatable, and securing said device to an inflated portion thereof.

3. The motor securing device of claim 2 including said securing means being defined by a pair of generally parallel walls and a connecting wall disposed therebetween.

4. The motor securing device of claim 1 including said shelf having an average width of about 1 to 1½ times the average width of said securing means.

5. The motor securing device of claim 4 including said motor securing device having a generally uniform width throughout its longitudinal extent.

6. The motor securing device of claim 1 including said retainer means having at least one upstanding peripheral wall portion.

7. The motor securing device of claim 6 including said peripheral wall being disposed at or adjacent the free edges of said shelf.

8. The motor securing device of claim 7 including said peripheral wall being substantially continuous.

9. A motor securing device for watercraft comprising generally downwardly open securing means for securing said device to said watercraft, motor attachment means projecting generally upwardly from a rear portion of said securing means, a battery securing shelf extending forwardly from said securing means, retainer means for resisting undesired displacement of a battery disposed on said shelf, said securing means having a channel for receipt of a portion of said watercraft, said watercraft being inflatable, securing said device to an inflated portion thereof, said securing means being defined by a pair of generally parallel walls and a connecting wall disposed therebetween, and said motor attachment means having an upwardly projecting wall which is generally an extension of the rearmost of said channel defining generally parallel walls, whereby a motor secured to said motor attachment means and a battery disposed on said shelf will provide a counterbalancing action.

10. The motor securing device of claim 9 including enlarged means on said upwardly projecting wall for receiving a portion of a motor securing clamp.

11. The motor securing device of claim 10 including spaced lateral walls connecting said upwardly projecting wall with said connecting wall, whereby undesired lateral displacement of said motor securing clamp will be resisted.

12. The motor securing device of claim 9 wherein said device is of unitary construction.

13. The motor securing device of claim 12 wherein said device is composed of a material selected from the group consisting of plastic, aluminum and steel.

14. The motor securing device of claim 9 including said shelf-projecting generally forwardly from the forward said channel defining parallel wall.

15. The motor securing device of claim 14 including said shelf connected to said forward parallel wall at or adjacent the lower extremity of said wall.

* * * * *